US006470516B2

(12) United States Patent
Lopez, Jr.

(10) Patent No.: US 6,470,516 B2
(45) Date of Patent: Oct. 29, 2002

(54) PORTABLE DOUBLE LEVEL CRADLE ROCKING BASSINET

(76) Inventor: Clisthenes F. Lopez, Jr., 2270 W. Sepulveda Blvd., No.102, Torrance, CA (US) 90501

( * ) Notice: Subject to any disclaimer, the term of this patent is extended or adjusted under 35 U.S.C. 154(b) by 111 days.

(21) Appl. No.: 09/798,805

(22) Filed: Mar. 1, 2001

(65) Prior Publication Data

US 2002/0120985 A1 Sep. 5, 2002

(51) Int. Cl.[7] ..... A47D 9/00
(52) U.S. Cl. ..... 5/105; 5/106; 5/107; 5/101
(58) Field of Search ..... 5/98.1, 99.1, 101, 5/102, 105, 106, 107

(56) References Cited

U.S. PATENT DOCUMENTS

| | | | | |
|---|---|---|---|---|
| 246,729 A | | 9/1881 | Darne | |
| 385,633 A | * | 7/1888 | Kelly et al. | 119/61 |
| 1,812,699 A | * | 6/1931 | Hursh | 5/102 |
| 2,106,927 A | * | 2/1938 | Kinnear | 297/130 |
| 2,293,560 A | | 8/1942 | Price | |
| 2,452,838 A | | 11/1948 | Come | |
| 2,793,374 A | | 5/1957 | Doud | |
| 2,869,145 A | | 1/1959 | Gregory | |
| 2,936,464 A | | 5/1960 | Miller et al. | |
| 2,964,762 A | | 12/1960 | Reynolds | |
| 2,972,152 A | | 2/1961 | Vincent | |
| 3,158,877 A | | 12/1964 | Cooper | |
| 3,335,433 A | * | 8/1967 | Stopek | 446/396 |
| 4,891,852 A | | 1/1990 | Lopez, Jr. | |
| 5,271,107 A | | 12/1993 | Golf et al. | |
| 5,694,655 A | | 12/1997 | Shepler et al. | |
| 5,819,341 A | | 10/1998 | Simantob et al. | |
| 6,026,524 A | | 12/2000 | Barger | |

* cited by examiner

*Primary Examiner*—Michael F. Trettel
(74) *Attorney, Agent, or Firm*—Thomas I. Rozsa; Tony D. Chen

(57) ABSTRACT

A portable double level cradle rocking bassinet including a standard bassinet onto which is formed lower fixed rockers and also formed elongated foldout rockers. The bassinet has a frame portion to which are attached the lower fixed rockers on either end of the frame portion. When the bassinet is to be rocked, the individual simply unfolds the bassinet to the open condition, places the baby in the frame portion and then rocks the bassinet back and forth on the lower fixed rockers at a ground level. The bassinet also has foldout rockers which can be unfolded to the extended condition, so that the bassinet can be rocked back and forth at a bed or chair level. The foldout rockers can be stored by folding upwardly against the underside of the frame portion and are retained thereto by mating fasteners.

48 Claims, 5 Drawing Sheets

PORTABLE DOUBLE LEVEL CRADLE ROCKING BASSINET

BACKGROUND OF THE INVENTION

1. Field of the Invention

The present invention relates generally to the field of cradles. More particularly, the present invention relates to the field of portable bassinets which can be rocked at two different height levels.

2. Description of the Prior Art

Specifically, rockable bassinets are well known in the art. These prior art rockable bassinets can only be rocked at one height level, either at a ground or floor level or at an elevated height away from the ground, for example a bed or chair level.

The following fourteen (14) prior art patents are found to be pertinent to the field of the present invention:

1. U.S. Pat. No. 246,729 issued to Darne on Sep. 6, 1881 for "Combined Cradle And Nursery" (hereafter the "Darne Patent");
2. U.S. Pat. No. 2,293,560 issued to Price on Aug. 18, 1942 for "Combination Cradle And Carriage" (hereafter the "Price Patent");
3. U.S. Pat. No. 2,452,838 issued to Come on Nov. 2, 1948 for "Furniture" (hereafter the "Come Patent");
4. U.S. Pat. No. 2,793,374 issued to Doud on May 28, 1957 for "Folding Cradle And Rocker" (hereafter the "Doud Patent");
5. U.S. Pat. No. 2,869,145 issued to Gregory on Jan. 20, 1959 for "Combination Cradle, Bassinet And Buggy" (hereafter the "Gregory Patent");
6. U.S. Pat. No. 2,936,464 issued to Miller et al. on May 17, 1960 for "Cradle" (hereafter the "Miller Patent");
7. U.S. Pat. No. 2,964,762 issued to Reynolds on Dec. 20, 1960 for "Rocking Bassinet" (hereafter the "Reynolds Patent");
8. U.S. Pat. No. 2,972,152 issued to Vincent on Feb. 21, 1961 for "Rocking Device For Bassinet" (hereafter the "Vincent Patent");
9. U.S. Pat. No. 3,158,877 issued to Cooper on Dec. 1, 1964 for "Supporting Rocker Frame" (hereafter the "Cooper Patent");
10. U.S. Pat. No. 4,891,852 issued to Lopez, Jr. on Jan. 9, 1990 for "Bassinet Rocker" (hereafter the "Lopez Patent");
11. U.S. Pat. No. 5,271,107 issued to Gof et al. on Dec. 21, 1993 for "Infant Bathing And Crib Device" (hereafter the "Gof Patent");
12. U.S. Pat. No. 5,694,655 issued to Shepler et al. on Dec. 9, 1997 for "Rocking Collapsible Bassinet" (hereafter the "Shepler Patent");
13. U.S. Pat. No. 5,819,341 issued to Simantob et al. on Oct. 13, 1998 for "Collapsible And Convertible Combination Baby Bed And Baby Carrier System" (hereafter the "Simantob Patent"); and
14. U.S. Pat. No. 6,026,524 issued to Barger on Feb. 22, 2000 for "Playyard With Rockers" (hereafter the "Barger Patent").

The Darne Patent discloses a combined cradle and nursery. The Darne Patent teaches a single level rocking cradle and nursery.

The Price Patent discloses a combination cradle and carriage. The Price Patent teaches a carriage which can be converted into a rockable cradle that can be rocked at one level.

The Come Patent discloses furniture which has rocking members that are pivotable down so that the furniture can rock.

The Doud Patent discloses a folding cradle and rocker.

The Gregory Patent discloses a combination cradle, bassinet and buggy.

The Miller Patent discloses a cradle. It includes a stand, a mounting and driving assembly removably supported by the stand, and cradle means removably and rockably supported by the mounting and driving assembly.

The Reynolds Patent discloses a rocking bassinet. The Reynolds Patent teaches a rocking bassinet that can only be rocked at a single level.

The Vincent Patent discloses a rocking device for a bassinet. The Vincent Patent teaches a single level rocking bassinet.

The Cooper Patent discloses a supporting rocker frame for receiving and supporting a removable crib or a baby carriage.

The Lopez Patent discloses a bassinet rocker. It utilizes an external rocking support for receiving the bassinet.

The Gof Patent discloses an infant bathing and crib device. It includes a frame which has a pair of parallel extending side frame members. A support hammock is secured to the frame members and rockable at a single level.

The Shepler Patent discloses a rocking collapsible bassinet. It includes hoop-shaped frame members which are pivotable about a pair of connectors between a laterally rocking position, a stationary position, and a collapsed storage position. One of the frame members serves as a handle with free ends pivotal between a ground-engaging position which prevents rocking and a non-ground engaging position which allows lateral rocking of the bassinet.

The Simantob Patent discloses a collapsible and convertible combination baby bed and baby carrier system.

The Barger Patent discloses a play-yard with rockers. The Barger Patent teaches lockable rocker members which convert the play-yard into a rocking device.

None of these prior art patents have disclosed a portable double level cradle rocking bassinet which can be rocked at two different height levels. Therefore, there is a need to provide a modern day baby's bassinet having lower fixed rocking members that can be rocked at a ground or floor level combined with elongated foldout rocking members to elevate the bassinet so that it can be rocked at a bed or chair level.

SUMMARY OF THE INVENTION

The present invention is a novel and unique portable double level cradle rocking bassinet which comprises a standard bassinet onto which is formed lower fixed rockers and formed elongated foldout rockers. The bassinet comprises a frame portion to which are attached the lower fixed rockers on either end of the frame portion. When the bassinet is to be rocked, the individual simply unfolds the bassinet to the open condition, places the baby in the frame portion and then rocks the bassinet back and forth on the lower fixed rockers at a ground level. The bassinet also has foldout rockers which can be unfolded to the extended condition, so that the bassinet can be rocked back and forth at a bed or chair level. The foldout rockers can be stored by folding upwardly against the underside of the frame portion and are retained thereto by mating VELCRO® fasteners.

It has been discovered, according to the present invention, that if a bassinet has lower fixed rocking members and foldout elongated rocking members, then the present invention can be rocked at two different height levels such as a ground level and a bed level.

It has further been discovered, according to the present invention, that if a bassinet has lower fixed rocking members for rocking the bassinet at a ground or floor level and is combined with foldout elongated rocking members which can be folded out for rocking the bassinet at a bed or chair level, then the present invention does not require external structures to lift the bassinet off the ground by a sufficient amount to permit the bassinet to freely rock back and forth at the bed level while the user is lying down on the bed.

It is an object of the present invention to provide a portable double level cradle rocking bassinet having lower fixed rocking members and foldout elongated rocking members, so that the bassinet can be rocked at two different height levels such as a ground level and a bed level.

It is a further object of the present invention to provide a portable double level cradle rocking bassinet having lower fixed rocking members for rocking the bassinet at a ground or floor level and combined with foldout elongated rocking members which can be folded out for rocking the bassinet at a bed or chair level, so that the present invention does not require external structures to lift the bassinet off the ground by a sufficient amount to permit the bassinet to freely rock back and forth at the bed level while the user is lying down on the bed.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENTS

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 1:
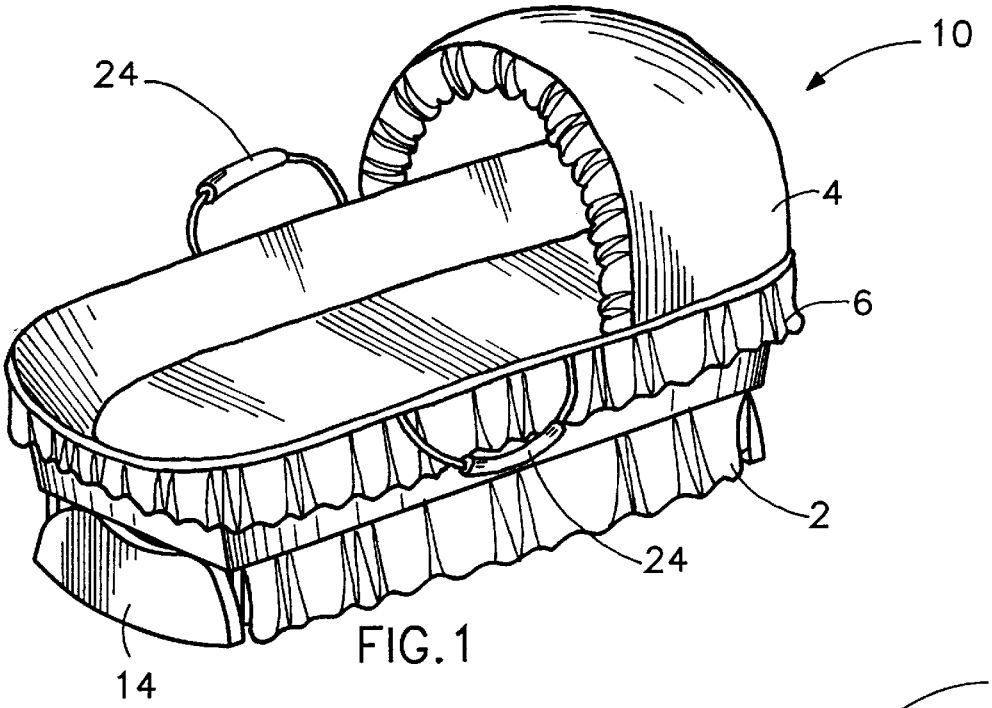
FIG. 1 is a perspective view of one embodiment of the present invention portable double level cradle rocking bassinet, showing the bassinet at the ground level including cloth covering and frilly lace extending from the sides of the bassinet and over the hood covering the baby's head.
Figure 2:
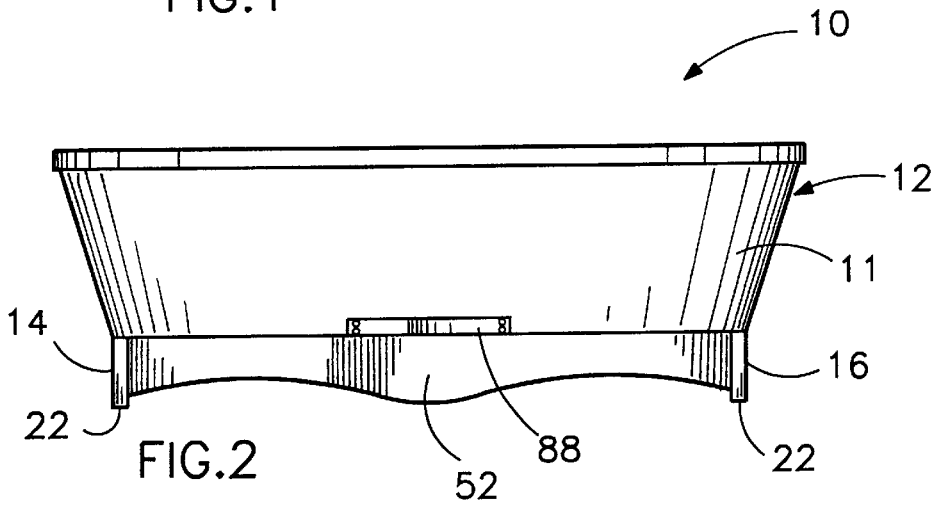
FIG. 2 is a side elevational view of the present invention portable double level cradle rocking bassinet, showing the bassinet at the ground level without the cloth covering and the hood.

Referring to FIG. 1, there is shown at 10 the present invention portable double level cradle rocking bassinet shown in the lengthwise or head to toe direction. The bassinet 10 usually comprises a cloth skirt 2, a hood portion 4 and frilly lace 6. For clarity purposes of illustrating the present invention portable double level cradle rocking bassinet 10, the cloth skirt 2, the hood portion 4 and frilly lace 6 thereon have been removed from the bassinet in the following illustrations.

Referring to FIGS. 2 through 8, the bassinet 10 comprises a generally elliptical shaped bed or frame portion 12 which includes a horizontal flat bottom 8 and a foldable circumferential sidewall 11 which extends upwardly from the flat bottom 8. The bassinet 10 also comprises a pair of lower fixed rockers 14 and 16, and a pair of elongated foldout rocking assemblies 17 and 19. The lower fixed rockers 14 and 16 are affixed to the underside of the frame portion 12 by any type of conventional fastening means such as screws, nuts and bolt arrangement, nails, brads, tacks, staples, or brackets and located on opposite ends. The pair of foldout rocking assemblies 17 and 19 are hingeably attached to the underside of the frame portion 12 and located on opposite ends of the frame portion 12 and respectively adjacent to the interior of the pair of lower fixed rockers 14 and 16. The frame portion 12 may be conventionally made of fold-up material so it can be folded flat for travel. The bassinet 10 can therefore be folded flat and then carried by straps 24 which are respectively attached to the sides of the frame portion 12 of the bassinet 10 for assisting the user to carry or move the bassinet around (see FIG. 1). The bassinet 10 further has straps 88 which are respectively attached to the sides of the frame portion 12 and located adjacent to the flat bottom 8. By way of example, strap means 24 can be used for carrying the bassinet 10 when the bassinet is in the folded condition, unfolded condition or when the foldout rockers are fully extended. By way of example, strap means 88 are used for assisting the user when the bassinet 10 and the foldout rocking assemblies 17 and 19 are in the folded condition. Therefore, the bassinet 10 can be conveniently carried sideways, like a briefcase or a suitcase. Most conventionally, the bassinet can have the lower portion including the foldout rocking assemblies folded up while the frame portion 12 remains in the unfolded condition so that the baby can be retained in the bassinet and then the bassinet can be carried by strap members 24 which conventionally are rotated together so that they can be held in one hand. It is also possible to carry the bassinet in this manner when it is folded flat as previously described. Most conventionally, when the bassinet is completely folded flat including having the frame portion folded flat in addition to having the rocking assemblies 17 and 19 folded flat, the bassinet is essentially carried sideways and can be carried by either one of the strap members 88 located on opposite sides of the bassinet frame portion 12. When it is desired to use the bassinet 10, the individual simply unfolds the frame portion 12 to the unfolded condition and then, the baby is placed therein and rocked on the lower fixed rockers 14 and 16 at a ground level. The bassinet 10 can also be rocked on the foldout rocking assemblies 17 and 19 at a bed or chair level.

Figure 5:
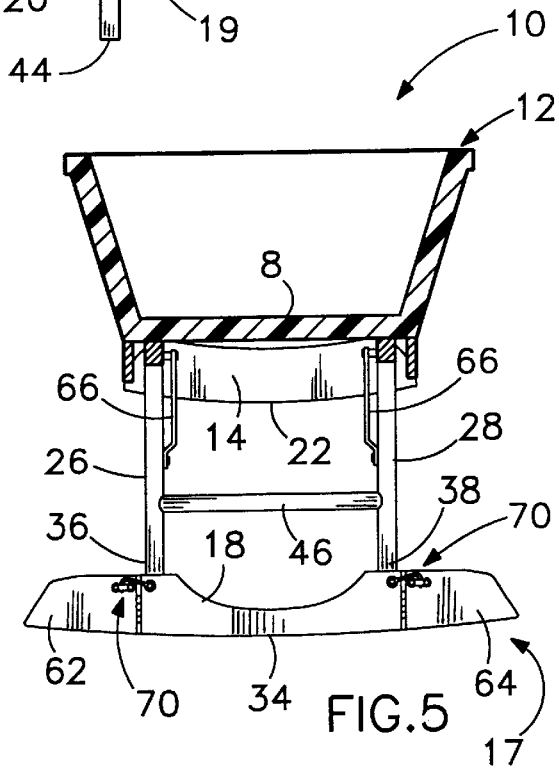
FIG. 5 is a cross-sectional taken along line 5—5 of FIG. 4.
Figure 6:
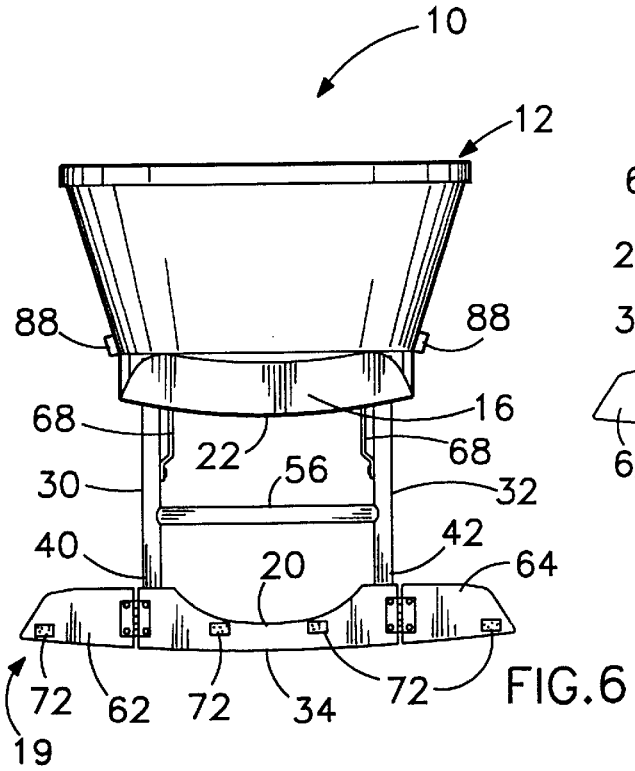
FIG. 6 is an end view of the present invention portable double level cradle rocking bassinet with the extendable rockers fully extended.

Referring to FIGS. 1, 5 and 6, each of the lower fixed rockers 14 and 16 comprises an arcuate lower surface 22. The pair of lower fixed rockers 14 and 16 are aligned generally parallel to each other such that their respective lower arcuate surfaces 22 are in the same plane and along which the bassinet 10 can be rocked back and forth. Both lower fixed rockers 14 and 16 extend along the widthwise direction of the frame portion 12. The lower fixed rockers 14 and 16 are affixed to the underside of the frame portion 12 by conventional means and flush with the ends of the frame portion 12 so that they are hidden underneath the frame portion when viewed from the top.

Supported on a pair of elongated vertical columns or posts 26 and 28, and attached to their bottom ends 36 and 38 is a first foldout rocker 18 comprising an arcuate lower surface 34. The pair of vertical columns 26 and 28 are secured together in a spaced apart relationship by a horizontal cross-beam 46 in the widthwise direction. The upper ends of the vertical columns 26 and 28 are hingeably attached to the underside of the frame portion 12. Supported on a pair of elongated vertical columns 30 and 32 and attached to their bottom ends 40 and 42 is a second foldout rocker 20 comprising an arcuate lower surface 34. The pair of vertical columns 30 and 32 are secured together in a space apart relationship by a horizontal cross-beam 56 in the widthwise direction. The upper ends of the vertical columns 30 and 32 are hingeably attached to the underside of the frame portion 12. The first and second foldout rockers 18 and 20 are aligned generally parallel to each other such that their respective lower arcuate surfaces 34 are in the same plane and along which the bassinet 10 can be rocked back and forth at an elevated level. Both rockers 18 and 20 extend along the widthwise direction of the frame portion 12. Each rocker further comprises a pair of expandable stabilizing means 62 and 64 which are hinged at opposite ends of the rocker to further widen the foldout rockers for stabilizing and preventing the bed portion 12 from tipping over from over rocking when it is rocked back and forth. The expandable stabilizing means 62 and 64 can be swung outwardly to extend the rockers 18 and 20 and secured thereto by a hook and eye type arrangement 70. When the expandable stabilizing means 62 and 64 are not in use, they are outwardly folded against the rockers 18 and 20 and are retained thereto by mating VELCRO® fasteners 72 or other suitable means.

Figure 4:
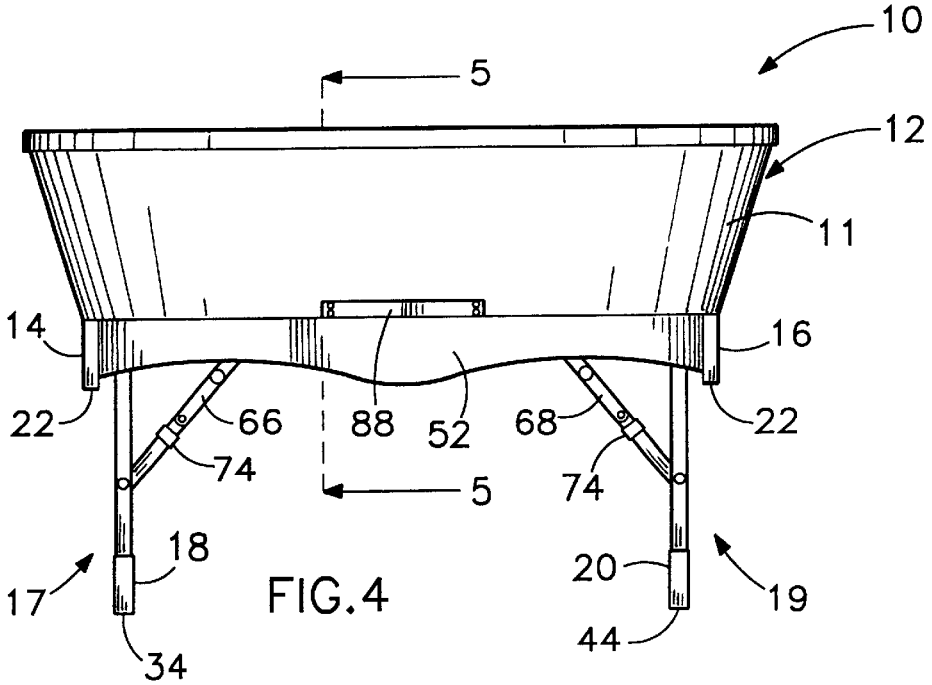
FIG. 4 is a side elevational view of the present invention portable double level cradle rocking bassinet, showing the bassinet at a bed or chair level with the foldout rocking members in the unfolded condition or extended condition.

Referring to FIGS. 4, 5 and 6, a unique feature of the present invention is that the combined vertical height of each of the four vertical columns 26, 28, 30 and 32 and the extra height added by the rockers 18 and 20 is equal or greater than the vertical height of a bed frame or chair so that the bassinet 10 may be rocked at the bed or chair level without any external structures. In this manner, the rockers 18 and 20 can cause the bassinet 10 to be rocked back and forth at the bed or chair level.

It will be appreciated that the expandable stabilizing means 62 and 64 are not limited to the illustration shown in the figures. It is emphasized that while the expandable stabilizing means are hinged together, it is also within the spirit and scope of the present invention to have telescopic stabilizing means which can extend out from the ends of the foldout rockers 18 and 20.

Figure 3:
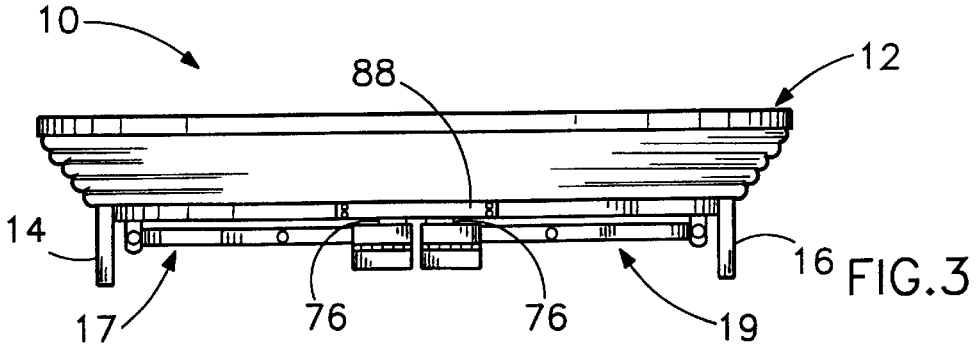
FIG. 3 is a side elevational view of the present invention portable double level cradle rocking bassinet shown in FIG. 2 without the side cover panel.
Figure 7:
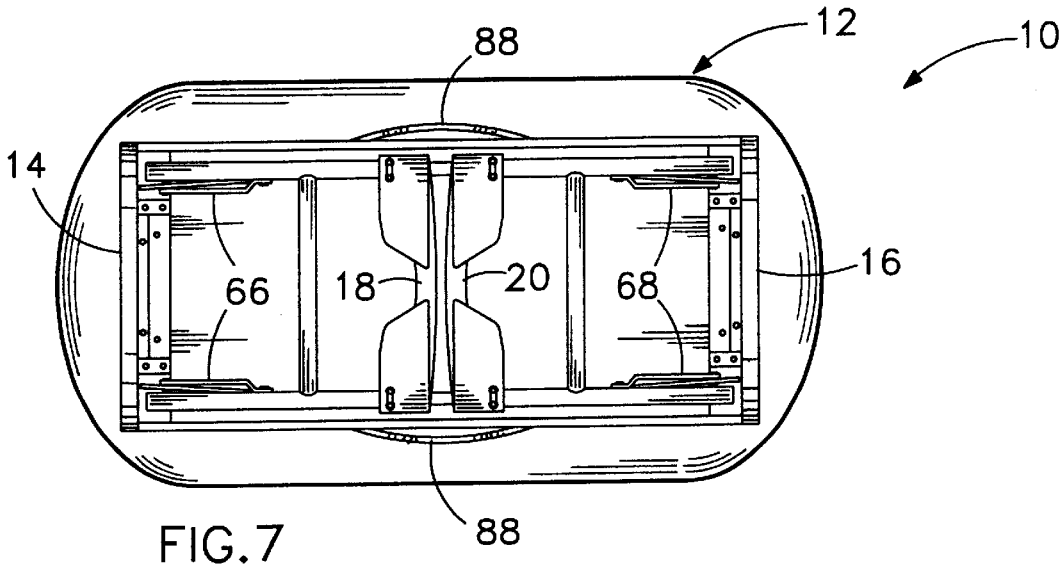
FIG. 7 is a bottom plan view of the present invention portable double level cradle rocking bassinet with the foldout rocking members in the stored condition or collapsed condition.
Figure 8:
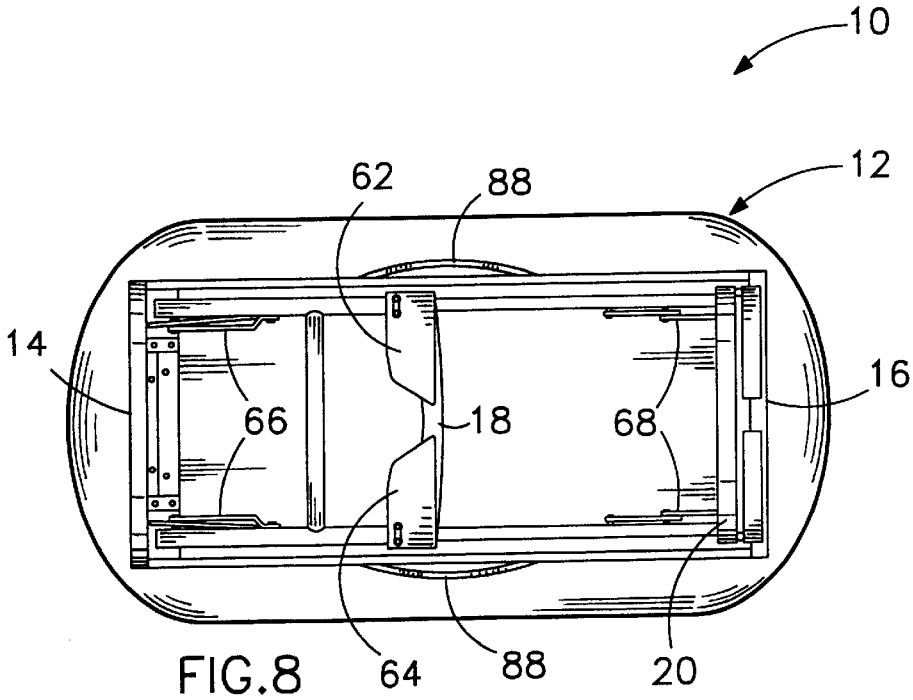
FIG. 8 is a bottom plan view of the present invention portable double level cradle rocking bassinet with the foldout rocking members in the unfolded condition or extended condition.

Referring FIGS. 3, 7 and 8, the first and second foldout rocking assemblies 17 and 19 of the bassinet 10 can usually be stored by folding them up against the bottom of the frame portion 12 and secured thereto by mating VELCRO® fasteners 76 at the interior edges of the rockers 18 and 20 and the middle of the frame portion 12. These first and second foldout rocking assemblies 17 and 19 are hidden away from site by side cover panels 52 (see FIGS. 2 and 4). The foldout rocking assemblies 17 and 19 can be folded-out by extending the foldout rocking assemblies 17 and 19 and held thereto by folding metal braces 66 and 68. There is one folding metal brace for each vertical column. The upper ends of the folding metal braces 66 and 68 are attached to the underside of the frame portion 12 while the bottom ends of the metal braces 66 and 68 are respectively attached to each vertical column. Each metal brace has a sliding clamp 74 for preventing the metal brace from accidentally folding.

Figure 9:
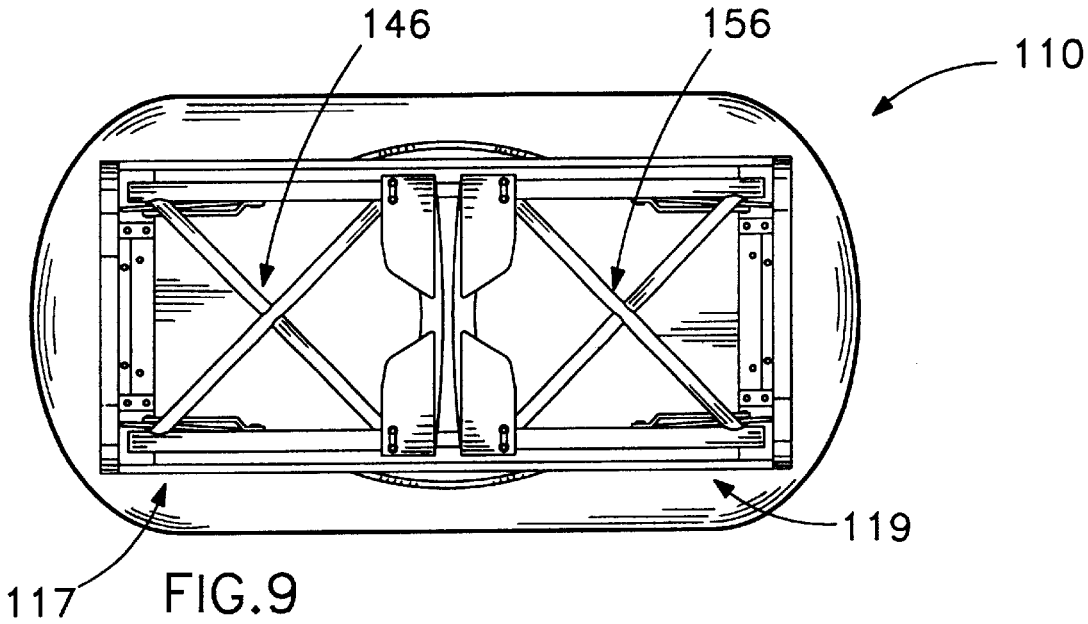
FIG. 9 is a bottom plan view of an alternative embodiment of the present invention portable double level cradle rocking bassinet with the foldout rocking members in the stored condition or collapsed condition.
Figure 10:
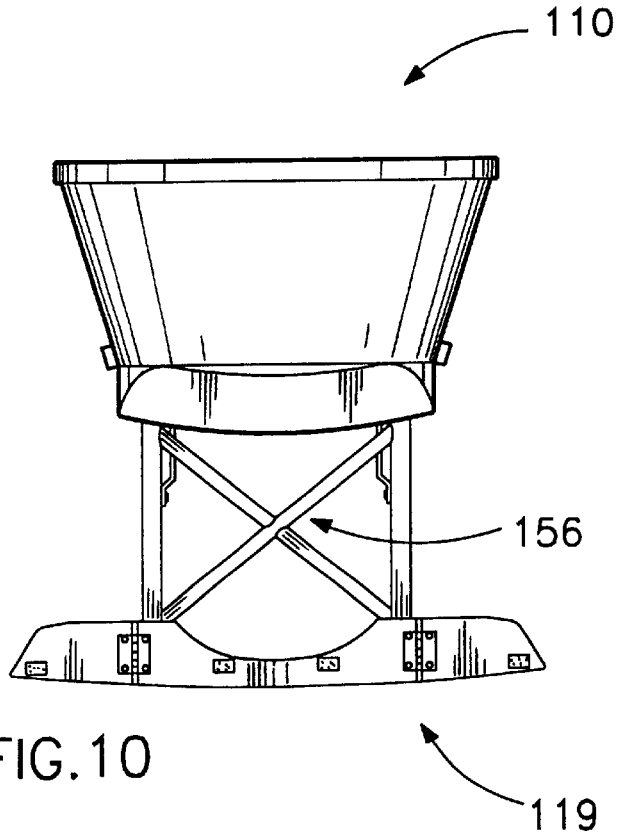
FIG. 10 is an end plan view of the present invention portable double level cradle rocking bassinet shown in FIG. 9, with the foldout rocking members in the unfolded condition or extended condition.

Referring to FIGS. 9 and 10, there is shown an alternative embodiment of the present invention portable double level cradle rocking bassinet 110. This embodiment is very similar to the preceding embodiment just discussed and the only difference is the nature and configuration of the first and second foldout rocking assemblies 117 and 119. In this embodiment, the horizontal cross-beams 46 and 56 (see FIGS. 5 and 6) are replaced with diagonally mounted supports 146 and 156 as shown. Since the double level cradle rocking bassinet 110 assembles and functions the same as previously described in the preceding embodiment, the components are numbered correspondingly with 100 added to each number, and the description thereof will not be repeated.

Figure 11:
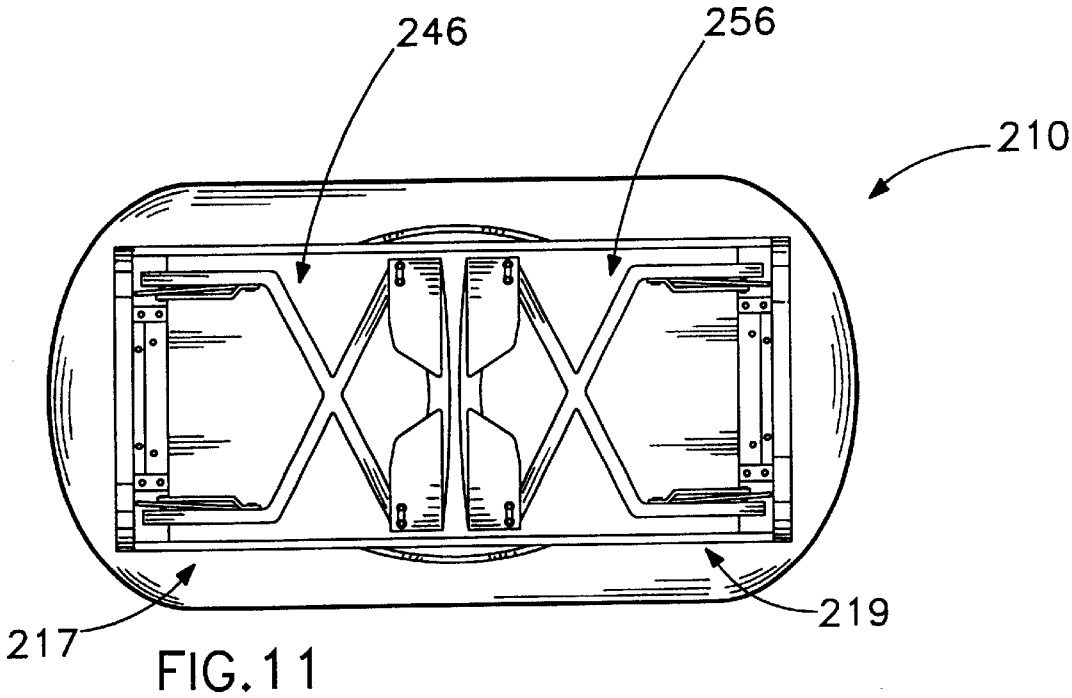
FIG. 11 is a bottom plan view of a further alternative embodiment of the present invention portable double level cradle rocking bassinet with the foldout rocking members in the stored condition or collapsed condition.
Figure 12:
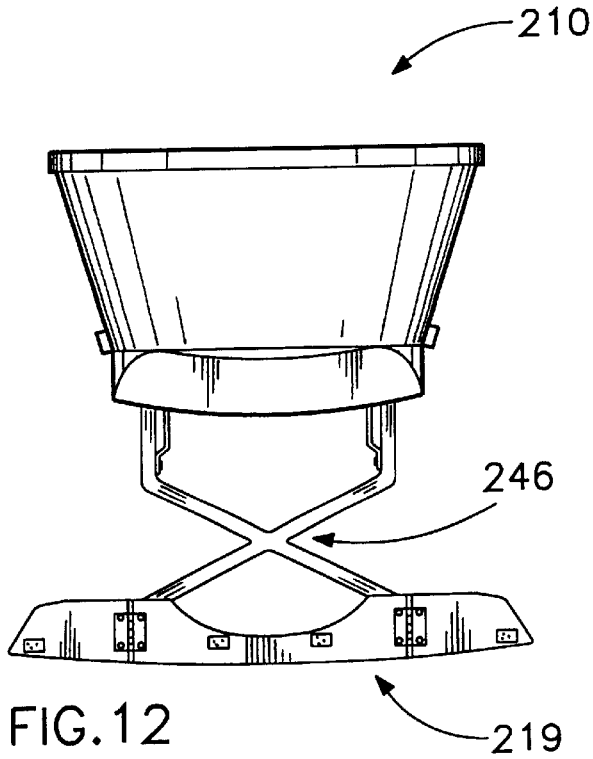
FIG. 12 is an end plan view of the present invention portable double level cradle rocking bassinet shown in FIG. 11, with the foldout rocking members in the unfolded condition or extended condition.

Referring to FIGS. 11 and 12, there is shown a further alternative embodiment of the present invention portable double level cradle rocking bassinet 210. This embodiment is very similar to the preceding embodiment just discussed and the only difference is the nature and configuration of the first and second foldout rocking assemblies 217 and 219. In this embodiment, the vertical columns 26, 28, 30 and 32 (see FIGS. 5 and 6) extend down to a short distance and are connected to the upper ends of the diagonally mounted supports 246 and 256 as shown. Since the double level cradle rocking bassinet 210 assembles and functions the same as previously described in the preceding embodiment, the components are numbered correspondingly with 200 added to each number, and the description thereof will not be repeated.

The various dimensions of the components of the bassinet are a matter of design choice. The present invention conforms to conventional forms of manufacture or any other conventional way known to one skilled in the art, and is of simple construction and is easy to use. By way of example, the portable double level cradle rocking bassinet may be of plastic material or any other suitable material known in the art. The manufacturing process which could accommodate the construction of the portable double level cradle rocking bassinet may be injection, thermoform, etc. or other molding process.

Defined in detail, the present invention is a portable double level cradle rocking bassinet, comprising: (a) an elongated bed portion having a horizontally disposed bottom surface and a foldable circumferential sidewall extending upwardly from the bottom surface; (b) a first lower rocker having an arcuate lower surface and affixed to the underside of the bottom surface and located adjacent to one end of the bed portion; (c) a second lower rocker having an arcuate lower surface and affixed to the underside of the bottom surface and located adjacent to the other end of the bed portion; (d) the first and second rockers aligned parallel to one another such that the lowermost portions of their respective arcuate lower surfaces lie in the same plane for rocking back and forth the bed portion at a ground level; (e) a first pair of elongated vertical posts hingeably connected to the underside of the bottom surface of the bed portion and located adjacent to the first lower rocker, the first vertical posts being spaced apart and vertically aligned relative to each other; (f) a second pair of elongated vertical posts hingeably connected to the underside of the bottom surface of the bed portion and located adjacent to the second lower rocker, the second vertical posts being spaced apart and vertically aligned relative to each other; (g) a first lower widthwise cross beam joining the first vertical posts together adjacent their lowermost ends; (h) a second lower widthwise cross beam joining the second vertical posts together adjacent their lowermost ends; (i) a third rocker affixed to bottom ends of the first vertical posts and having an arcuate lower surface; (j) a forth rocker affixed to bottom ends of the second vertical posts and having an arcuate lower surface; (k) the third and forth rockers aligned parallel to one another such that the lowermost portions of their respective arcuate lower surfaces lie in the same plane when the first and second vertical posts are in an unfolded condition for rocking the bed portion back and forth at a bed or chair level; (l) the third rocker further having a pair of foldout rocker extensions hingeably attached to the opposite ends for stabilizing and preventing the bed portion from tipping over from over rocking at the bed or chair level; (m) the forth rocker further having a pair of foldout rocker extensions hingeably attached to the opposite ends for stabilizing and preventing the bed portion from tipping over from over rocking at the bed or chair level; (n) means for securing the foldout rocking extensions of the third and forth rockers in an extended condition; (o) means for securing and storing the first and second vertical posts in a folded condition against the underside of the bed portion; and (p) means for securing and retaining the first and second vertical posts in the unfolded condition; (q) whereby the bassinet can be rocked on the first and second lower rockers at the ground level when the third and forth rockers are in the folded condition and when a horizontal rocking force is imparted to the bassinet, and the bassinet can be rocked at the bed or chair level when the third and forth rockers are in the unfolded condition, where the bassinet is approximately raised to the bed or chair level to permit the third and forth rockers to rock back and forth when a horizontal rocking force is imparted to the bassinet.

Defined broadly, the present invention is a double level rocking bassinet, comprising: (a) a bed portion having a bottom surface and a foldable sidewall extending upwardly from the bottom surface; (b) a pair of lower rocking members each having an arcuate lower surface and affixed to the underside of the bottom surface and located at opposite ends of the bed portion, the pair of lower rocking members aligned parallel to one another such that the lowermost portions of their respective arcuate lower surfaces lie in the same plane for rocking back and forth the bed portion at a ground level; (c) a pair of spaced apart first posts hingeably connected to the underside of the bottom surface of the bed portion and located adjacent to the one end; (d) a pair of spaced apart second posts hingeably connected to the underside of the bottom surface of the bed portion and located adjacent to the other end; (e) means for joining the pair of first posts; (f) means for joining the pair of second posts; (g) a third rocking member affixed to bottom ends of the first posts and having an arcuate lower surface; (h) a forth rocking member affixed to bottom ends of the second posts and having an arcuate lower surface; (i) the third and forth rocking members aligned parallel to one another such that the lowermost portions of their respective arcuate lower surfaces lie in the same plane when the first and second posts are in an unfolded condition for rocking the bed portion back and forth at a bed or chair level; (j) means for stabilizing and preventing the bed portion from tipping over from over rocking at the bed or chair level; (k) means for securing and storing the first and second posts in a folded condition against the underside of the bed portion; and (l) means for securing and retaining the first and second posts in the unfolded condition; (m) whereby the bed portion can be rocked on the first and second rocking members at the ground level when the third and forth rocking members are in the folded condition and when a horizontal rocking force is imparted to the bed portion, and the bed portion can be rocked at the bed or chair level when the third and forth rocking members are in the unfolded condition, where the bed portion is approximately raised to the bed or chair level to permit the third and forth rocking members to rock back and forth when a horizontal rocking force is imparted to the bed portion.

Defined more broadly, the present invention is a double level rocking bassinet, comprising: (a) a bed portion having a base and a sidewall extending upwardly from the base; (b) at least two lower rocking members affixed to the underside of the bed portion, each having a lower rocking member having an arcuate lower surface, the at least two lower rocking members aligned parallel to one another such that the lowermost portions of their respective arcuate lower surfaces lie in the same plane for rocking back and forth the bed portion at a ground level; (c) at least two elevated foldout rocking members hingeably connected to the underside of the base, each having an arcuate lower surface, when the at least two elevated foldout rocking members are in an unfolded condition, the at least two elevated foldout rocking members are aligned parallel to one another such that the lowermost portions of their respective arcuate lower surfaces lie in the same plane for rocking back and forth the bed portion at a bed or chair level; (d) the each elevated foldout rocking member further having means for stabilizing and preventing the bed portion from tipping over at the bed or chair level; (e) means for securing and storing the at least two elevated rocking members in a folded condition against the underside of the bed portion; and (f) means for securing and retaining the at least two elevated rocking members in the unfolded condition; (g) whereby the bassinet can be rocked on the at least two lower rocking members at the ground level when the at least two elevated rocking members are in the folded condition and when a horizontal rocking force is imparted to the bassinet, the bassinet can be rocked at the bed or chair level when the at least two elevated rocking members are in the unfolded condition, where the bassinet is raised approximately to the bed or chair level to permit the at least two elevated rocking members to rock back and forth when a horizontal rocking force is imparted to the bassinet.

Defined even more broadly, the present invention is a double level rocking bassinet, comprising: (a) a bed portion having a base and a sidewall extending upwardly from the base; (b) at least two lower rocking members affixed to the underside of the bed portion, each having a lower rocking member having an arcuate lower surface, the at least two lower rocking members aligned parallel to one another such that the lowermost portions of their respective arcuate lower surfaces lie in the same plane for rocking back and forth the bed portion at a ground level; and (c) at least two elevated foldout rocking members hingeably connected to the underside of the base, each having an arcuate lower surface, when the at least two elevated foldout rocking members are in an unfolded condition, the at least two elevated foldout rocking members are aligned parallel to one another such that the lowermost portions of their respective arcuate lower surfaces lie in the same plane for rocking back and forth the bed portion at a bed or chair level; (d) whereby the bassinet can be rocked on the at least two lower rocking members at the ground level when the at least two elevated rocking members are in the folded condition and when a horizontal rocking force is imparted to the bassinet, the bassinet can be rocked at the bed or chair level when the at least two elevated rocking members are in the unfolded condition, where the bassinet is raised approximately to the bed or chair level to permit the at least two elevated rocking members to rock back and forth when a horizontal rocking force is imparted to the bassinet.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

The present invention has been described in considerable detail in order to comply with the patent laws by providing full public disclosure of at least one of its forms. However, such detailed description is not intended in any way to limit the broad features or principles of the present invention, or the scope of the patent to be granted. Therefore, the invention is to be limited only by the scope of the appended claims.

What is claimed is:

1. A portable double level cradle rocking bassinet, comprising:

a. an elongated bed portion having a horizontally disposed bottom surface and a foldable circumferential sidewall extending upwardly from the bottom surface;

b. a first lower rocker having an arcuate lower surface and affixed to the underside of said bottom surface and located adjacent to one end of said bed portion;

c. a second lower rocker having an arcuate lower surface and affixed to the underside of said bottom surface and located adjacent to the other end of said bed portion;

d. said first and second rockers aligned parallel to one another such that the lowermost portions of their respective arcuate lower surfaces lie in the same plane for rocking back and forth said bed portion at a ground level;

e. a first pair of elongated vertical posts hingeably connected to the underside of said bottom surface of said bed portion and located adjacent to said first lower rocker, the first vertical posts being spaced apart and vertically aligned relative to each other;

f. a second pair of elongated vertical posts hingeably connected to the underside of said bottom surface of said bed portion and located adjacent to said second lower rocker, the second vertical posts being spaced apart and vertically aligned relative to each other;

g. a first lower widthwise cross beam joining said first vertical posts together adjacent their lowermost ends;

h. a second lower widthwise cross beam joining said second vertical posts together adjacent their lowermost ends;

i. a third rocker affixed to bottom ends of said first vertical posts and having an arcuate lower surface;

j. a forth rocker affixed to bottom ends of said second vertical posts and having an arcuate lower surface;

k. said third and forth rockers aligned parallel to one another such that the lowermost portions of their respective arcuate lower surfaces lie in the same plane when said first and second vertical posts are in an unfolded condition for rocking said bed portion back and forth at a bed or chair level;

l. said third rocker further having a pair of foldout rocker extensions hingeably attached to the opposite ends for stabilizing and preventing said bed portion from tipping over from over rocking at said bed or chair level;

m. said forth rocker further having a pair of foldout rocker extensions hingeably attached to the opposite ends for stabilizing and preventing said bed portion from tipping over from over rocking at said bed or chair level;

n. means for securing said foldout rocking extensions of said third and forth rockers in an extended condition;

o. means for securing and storing said first and second vertical posts in a folded condition against the underside of said bed portion; and p. means for securing and retaining said first and second vertical posts in said unfolded condition;

q. whereby said bassinet can be rocked on said first and second lower rockers at said ground level when said third and forth rockers are in said folded condition and when a horizontal rocking force is imparted to said bassinet, and said bassinet can be rocked at said bed or chair level when said third and forth rockers are in said unfolded condition, where said bassinet is approximately raised to said bed or chair level to permit said third and forth rockers to rock back and forth when a horizontal rocking force is imparted to said bassinet.

2. The portable double level cradle rocking bassinet in accordance with claim 1, wherein said bed portion is made out of plastic material.

3. The portable double level cradle rocking bassinet in accordance with claim 1, wherein means for securing said foldout rocking extensions of said third and forth rockers in said extended condition includes a hook and eye type arrangement.

4. The portable double level cradle rocking bassinet in accordance with claim 1, wherein said means for securing and retaining said first and second vertical posts in said unfolded condition includes folding braces.

5. The portable double level cradle rocking bassinet in accordance with claim 1, wherein said means for securing and storing said first and second vertical posts in said folded condition includes mating fasteners respectively attached to the underside of said bottom surface of said bed portion and said first and second vertical posts.

6. The portable double level cradle rocking bassinet in accordance with claim 1, further comprising means for carrying said bassinet.

7. The portable double level cradle rocking bassinet in accordance with claim 6, wherein said means for carrying said bassinet in said folded condition, said unfolded condition or said extended condition includes strap means located on either lengthwise side of said bassinet.

8. The portable double level cradle rocking bassinet in accordance with claim 6, wherein said means for carrying said bassinet in a sideway configuration includes second strap means located adjacent to said bottom surface of said bed portion.

9. A double level rocking bassinet, comprising:

a. a bed portion having a bottom surface and a foldable sidewall extending upwardly from the bottom surface;

b. a pair of lower rocking members each having an arcuate lower surface and affixed to the underside of said bottom surface and located at opposite ends of said bed portion, the pair of lower rocking members aligned parallel to one another such that the lowermost portions of their respective arcuate lower surfaces lie in the same plane for rocking back and forth said bed portion at a ground level;

c. a pair of spaced apart first posts hingeably connected to the underside of said bottom surface of said bed portion and located adjacent to said one end;

d. a pair of spaced apart second posts hingeably connected to the underside of said bottom surface of said bed portion and located adjacent to the other end;

e. means for joining said pair of first posts;

f. means for joining said pair of second posts;

g. a third rocking member affixed to bottom ends of said first posts and having an arcuate lower surface;

h. a forth rocking member affixed to bottom ends of said second posts and having an arcuate lower surface;

i. said third and forth rocking members aligned parallel to one another such that the lowermost portions of their respective arcuate lower surfaces lie in the same plane when said first and second posts are in an unfolded condition for rocking said bed portion back and forth at a bed or chair level;

j. means for stabilizing and preventing said bed portion from tipping over from over rocking at said bed or chair level;

k. means for securing and storing said first and second posts in a folded condition against the underside of said bed portion; and l. means for securing and retaining said first and second posts in said unfolded condition;

m. whereby said bed portion can be rocked on said first and second rocking members at said ground level when said third and forth rocking members are in said folded condition and when a horizontal rocking force is imparted to said bed portion, and said bed portion can be rocked at said bed or chair level when said third and forth rocking members are in said unfolded condition, where said bed portion is approximately raised to said bed or chair level to permit said third and forth rocking members to rock back and forth when a horizontal rocking force is imparted to said bed portion.

10. The double level rocking bassinet in accordance with claim 9, wherein said bed portion is made out of plastic material.

11. The double level rocking bassinet in accordance with claim 9, wherein said means for securing and retaining said first and second posts in said unfolded condition includes folding braces.

12. The double level rocking bassinet in accordance with claim 9, wherein said means for securing and storing said first and second posts in said folded condition includes mating fasteners respectively attached to the underside of said bottom surface of said bed portion and said first and second posts.

13. The double level rocking bassinet in accordance with claim 9, wherein said means for joining said pair of first posts includes a first cross beam adjacent their lowermost ends.

14. The double level rocking bassinet in accordance with claim 9, wherein said means for joining said pair of second posts includes a second cross-beam adjacent their lowermost ends.

15. The double level rocking bassinet in accordance with claim 9, wherein said means for stabilizing and preventing said bed portion from tipping over from over rocking at said bed or chair level includes a pair of first rocking extensions hingeably attached to the opposite ends of said third rocking member and a pair of second rocking extensions hingeably attached to the opposite ends of said forth rocking member.

16. The double level rocking bassinet in accordance with claim 9, further comprising means for securing said pairs of first and second rocking extensions in an extended condition.

17. The double level rocking bassinet in accordance with claim 16, wherein said means for securing said pairs first and second rocking extensions in said extended condition includes a hook and eye type arrangement.

18. The double level rocking bassinet in accordance with claim 9, further comprising means for carrying said bassinet.

19. The double level rocking bassinet in accordance with claim 18, wherein said means for carrying said bassinet when it is in the folded condition, the unfolded condition or the extended condition includes strap means located on either lengthwise side of the bassinet.

20. The double level rocking bassinet in accordance with claim 18, wherein said means for carrying said bassinet in a sideway configuration includes second strap means located adjacent to said bottom surface of said bed portion.

21. A double level rocking bassinet, comprising:

a. a bed portion having a base and a sidewall extending upwardly from the base;

b. at least two lower rocking members affixed to the underside of said bed portion, each having lower rocking member having an arcuate lower surface, the at least two lower rocking members aligned parallel to one another such that the lowermost portions of their respective arcuate lower surfaces lie in the same plane for rocking back and forth said bed portion at a ground level;

c. at least two elevated foldout rocking members hingeably connected to the underside of said base, each having an arcuate lower surface, when the at least two elevated foldout rocking members are in an unfolded condition, the at least two elevated foldout rocking members are aligned parallel to one another such that the lowermost portions of their respective arcuate lower surfaces lie in the same plane for rocking back and forth said bed portion at a bed or chair level;

d. said each elevated foldout rocking member further having means for stabilizing and preventing said bed portion from tipping over at said bed or chair level;

e. means for securing and storing said at least two elevated rocking members in a folded condition against the underside of said bed portion; and f. means for securing and retaining said at least two elevated rocking members in said unfolded condition;

g. whereby said bassinet can be rocked on said at least two lower rocking members at said ground level when said at least two elevated rocking members are in said folded condition and when a horizontal rocking force is imparted to said bassinet, said bassinet can be rocked at said bed or chair level when said at least two elevated rocking members are in said unfolded condition, where said bassinet is raised approximately to said bed or chair level to permit said at least two elevated rocking members to rock back and forth when a horizontal rocking force is imparted to said bassinet.

22. The double level rocking bassinet in accordance with claim 21, wherein said sidewall of said bed portion is made out of foldable material for folding and unfolding said sidewall.

23. The double level rocking bassinet in accordance with claim 21, wherein said bed portion is made out of plastic material.

24. The double level rocking bassinet in accordance with claim 21, wherein said means for stabilizing and preventing said bed portion from tipping over at said bed or chair level includes foldout extensions attached to the ends of said each elevated foldout rocking member.

25. The double level rocking bassinet in accordance with claim 21, further comprising means for securing said foldout extensions of said each elevated foldout rocking member in an extended condition.

26. The double level rocking bassinet in accordance with claim 25, wherein said means for securing said foldout extensions means includes a hook and eye type arrangement.

27. The double level rocking bassinet in accordance with claim 21, wherein said means for securing and storing said at least two elevated rocking members in said folded condition includes mating fasteners respectively attached to the underside of said base of said bed portion and said at least two elevated rocking members.

28. The double level rocking bassinet in accordance with claim 21, wherein said means for securing and retaining said at least two elevated rocking members in said unfolded condition includes folding braces.

29. The double level rocking bassinet in accordance with claim 21, further comprising means for carrying said bassinet.

30. The double level rocking bassinet in accordance with claim 29, wherein said means for carrying said bassinet when it is in the folded condition, the unfolded condition or the extended condition includes strap means located on either lengthwise side of the bassinet.

31. The double level rocking bassinet in accordance with claim 29, wherein said means for carrying said bassinet in a sideway configuration includes second strap means located adjacent to said base of said bed portion.

32. The double level rocking bassinet in accordance with claim 21, wherein said each elevated foldout rocking member further comprises a pair of spaced apart posts hingeably connected to the underside of said base of said bed portion and located adjacent to a respective arcuate lower surface.

33. The double level rocking bassinet in accordance with claim 21, wherein said each elevated foldout rocking member further comprises a pair of crisscross posts wherein one end of each post is attached to a respective end of said base of said bed portion and the other end attached to a respective arcuate lower surface.

34. The double level rocking bassinet in accordance with claim 21, wherein said each elevated foldout rocking member further comprises a pair of posts wherein the posts initially extend vertically so that one end is attached to a respective end of said base of said bed portion and then extend in a crisscross manner so that the lower end of a crisscross portion of the posts attached to a respective arcuate lower surface.

35. A double level rocking bassinet, comprising:

a. a bed portion having a base and a sidewall extending upwardly from the base;

b. at least two lower rocking members affixed to the underside of said bed portion, each having a lower rocking member having an arcuate lower surface, the at least two lower rocking members aligned parallel to one another such that the lowermost portions of their respective arcuate lower surfaces lie in the same plane for rocking back and forth said bed portion at a ground level; and c. at least two elevated foldout rocking members hingeably connected to the underside of said base, each having an arcuate lower surface, when the at least two elevated foldout rocking members are in an unfolded condition, the at least two elevated foldout rocking members are aligned parallel to one another such that the lowermost portions of their respective arcuate lower surfaces lie in the same plane for rocking back and forth said bed portion at a bed or chair level;

d. whereby said bassinet can be rocked on said at least two lower rocking members at said ground level when said at least two elevated rocking members are in said folded condition and when a horizontal rocking force is imparted to said bassinet, said bassinet can be rocked at said bed or chair level when said at least two elevated rocking members are in said unfolded condition, where said bassinet is raised approximately to said bed or chair level to permit said at least two elevated rocking members to rock back and forth when a horizontal rocking force is imparted to said bassinet.

36. The double level rocking bassinet in accordance with claim 35, wherein said sidewall of said bed portion is made out of foldable material for folding and unfolding said sidewall.

37. The double level rocking bassinet in accordance with claim 35, wherein said bed portion is made out of plastic material.

38. The double level rocking bassinet in accordance with claim 35, further comprising means for carrying said bassinet.

39. The double level rocking bassinet in accordance with claim 38, wherein said means for carrying said bassinet when it is in the folded condition, the unfolded condition or the extended condition includes strap means located on either lengthwise side of the bassinet.

40. The double level rocking bassinet in accordance with claim 38, wherein said means for carrying said bassinet in a sideway configuration includes second strap means located adjacent to said base of said bed portion.

41. The double level rocking bassinet in accordance with claim 35, further comprising means for stabilizing and preventing said bed portion from tipping over from over rocking at said bed or chair level.

42. The double level rocking bassinet in accordance with claim 41, wherein said means for stabilizing and preventing said bed portion from tipping over from over rocking at said bed or chair level includes foldout extensions attached to the ends of said each elevated foldout rocking member.

43. The double level rocking bassinet in accordance with claim 35, further comprising means for securing said foldout extensions of said each elevated foldout rocking member in an extended condition.

44. The double level rocking bassinet in accordance with claim 43, wherein said means for securing said foldout extensions includes a hook and eye type arrangement.

45. The double level rocking bassinet in accordance with claim 35, further comprising means for securing and storing said at least two elevated rocking members in a folded condition against the underside of said bed portion.

46. The double level rocking bassinet in accordance with claim 45, wherein said means for securing and storing said at least two elevated rocking members in said folded condition includes mating fasteners respectively attached to the underside of said base of said bed portion and said at least two elevated rocking members.

47. The double level rocking bassinet in accordance with claim 35, further comprising means for securing and retaining said at least two elevated rocking members in said unfolded condition.

48. The double level rocking bassinet in accordance with claim 47, wherein said means for securing and retaining said at least two elevated rocking members in said unfolded condition includes folding braces.

* * * * *